US006500094B1

(12) United States Patent
Lin

(10) Patent No.: US 6,500,094 B1
(45) Date of Patent: Dec. 31, 2002

(54) ELECTRIC REHABILITATION TREATMENT MACHINE

(75) Inventor: Shu Ting Lin, San-Chung (TW)

(73) Assignee: Unicorn Lake Enterprise Inc., Taipei (TW)

( * ) Notice: Subject to any disclaimer, the term of this patent is extended or adjusted under 35 U.S.C. 154(b) by 0 days.

(21) Appl. No.: 09/988,550

(22) Filed: Nov. 20, 2001

(51) Int. Cl.[7] ..... A63B 21/00

(52) U.S. Cl. ..... 482/1; 482/4; 482/900

(58) Field of Search ..... 482/1–9, 900–902; 601/23, 33, 34, 40

(56) References Cited

U.S. PATENT DOCUMENTS 4,979,733 A * 12/1990 Prud'Hon ..... 482/4
5,466,213 A * 11/1995 Hogan et al. ..... 601/33

* cited by examiner

*Primary Examiner*—Glenn E. Richman
(74) *Attorney, Agent, or Firm*—Bacon & Thomas, PLLC

(57) ABSTRACT

An electric rehabilitation treatment machine. The machine includes a casing, a reduction mechanism and a transmission mechanism, a control motor to drive the reduction mechanism, left and right transmission mechanisms at both sides thereof to drag connecting rods to let a foot-pedal at a front end to move upwards and downwards, so that such movement enables a hand-plate to perform an interlaced movement with the feet pedal, so as to provide a rehabilitant with a complete exercise of the feet and hands.

3 Claims, 6 Drawing Sheets

ELECTRIC REHABILITATION TREATMENT MACHINE

BACKGROUND OF THE INVENTION

1. Field of the Invention

The invention relates to a mechanism which can thoroughly rehabilitate the feet and hands of a human being.

2. Description of the Related Art

The structure of a conventional rehabilitation treatment machine is just aimed at a certain section of the body. For the example, in the case of a foot rehabilitation mechanism, a rehabilitant stands and treads on a pedal using his feet to apply a force. Relative to the rehabilitant, such a mechanism functions as a stairway provided for so treading upwards and downwards, so as to enable integral feet section including thighs cut and shanks to achieve the objective of receiving rehabilitation treatment. However, using such a mechanism, the rehabilitant must apply a force by himself to tread on the pedal. A rehabilitant having disabled or weaker feet may not be able to operate the mechanism by himself and consequently gets no benefit from such machine.

Further, there is another prior art device in the form of a treadmill which includes a movable footrest and handrails installed at both sides. A rehabilitant stands on such a moving footrest to perform a slow walking exercise, so as to achieve rehabilitation effect for his feet. Most prior art mechanisms permit the rehabilitant to take a standing posture so that he can stop for a rest after a period of treatment time. In terms of a product function, such devices fail to provide a complete rehabilitation effect. There is a need for another structure to overcome the foregoing shortcomings of conventional machines.

SUMMARY OF THE INVENTION

It is therefore a major object of the present invention to let the rehabilitant perform exercise treatment of his or her feet under a sitting posture.

Another object of the present invention is to let hands and feet perform an interlaced motion simultaneously so as to provide a complete rehabilitation treatment.

A BRIEF DESCRIPTION OF DRAWINGS

DETAILED DESCRIPTION OF THE INVENTION

Figure 4:
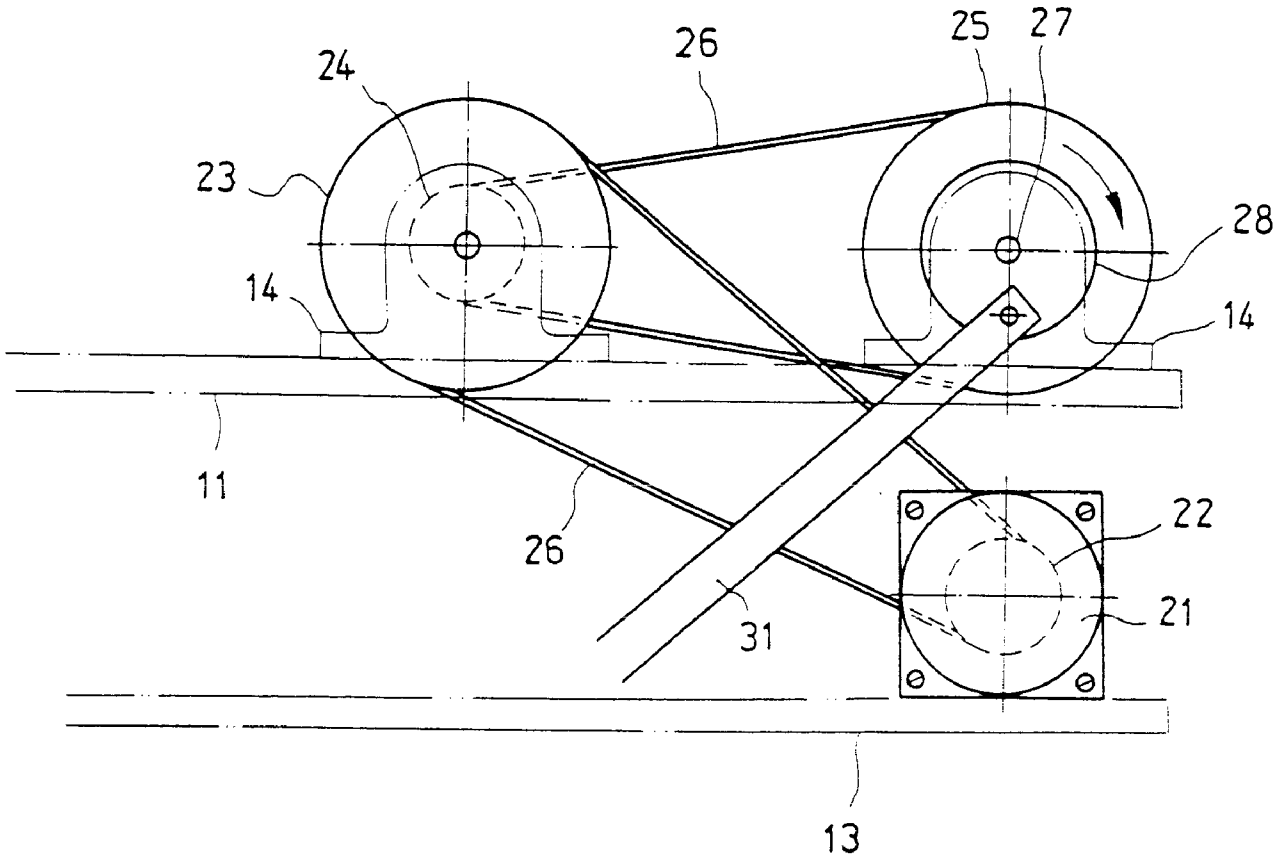
FIG. 4 is an operation illustration of a reduction mechanism of the present invention.
Figure 5:
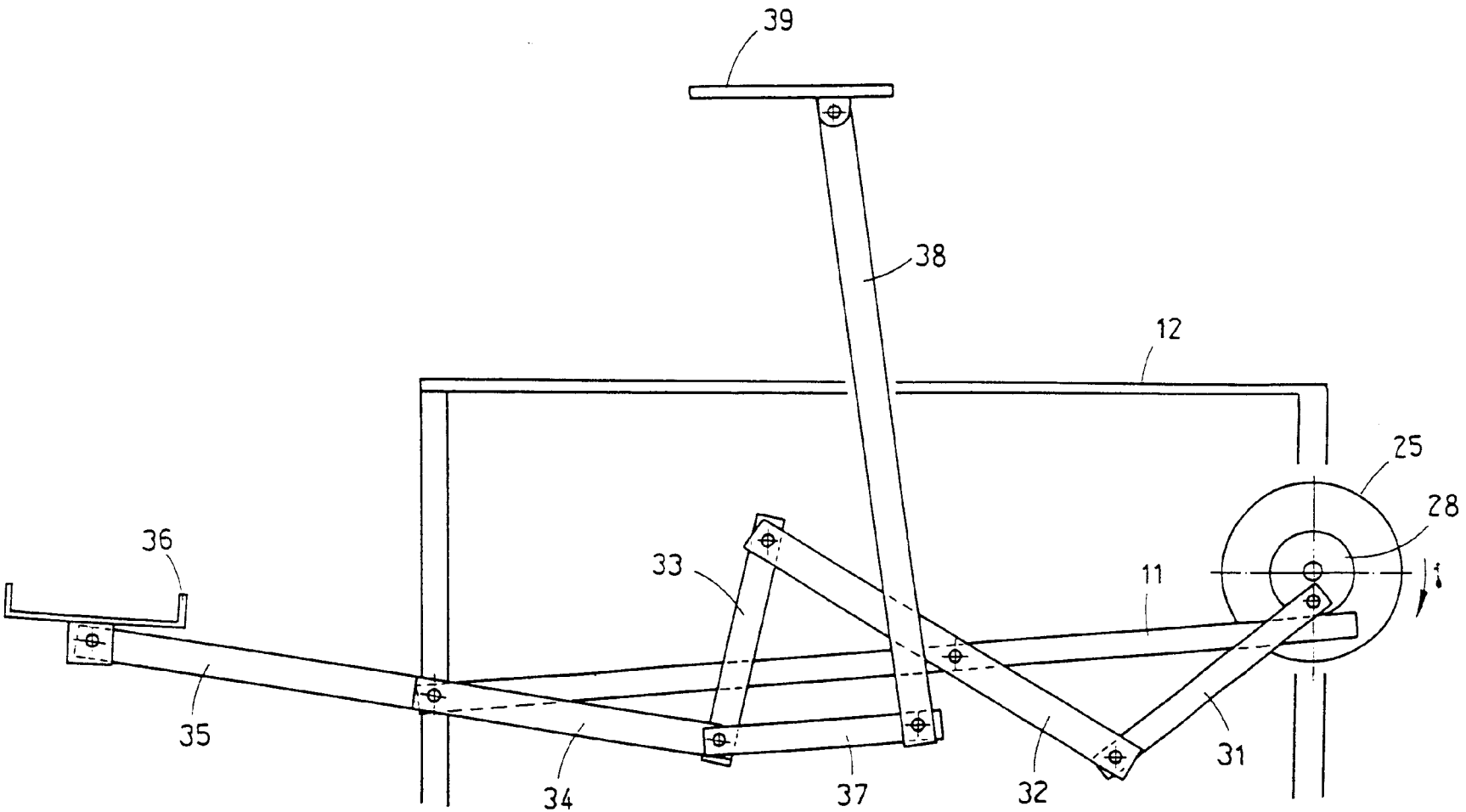
FIG. 5 is an operating procedure illustration of a transmission mechanism of the present invention.
Figure 6:
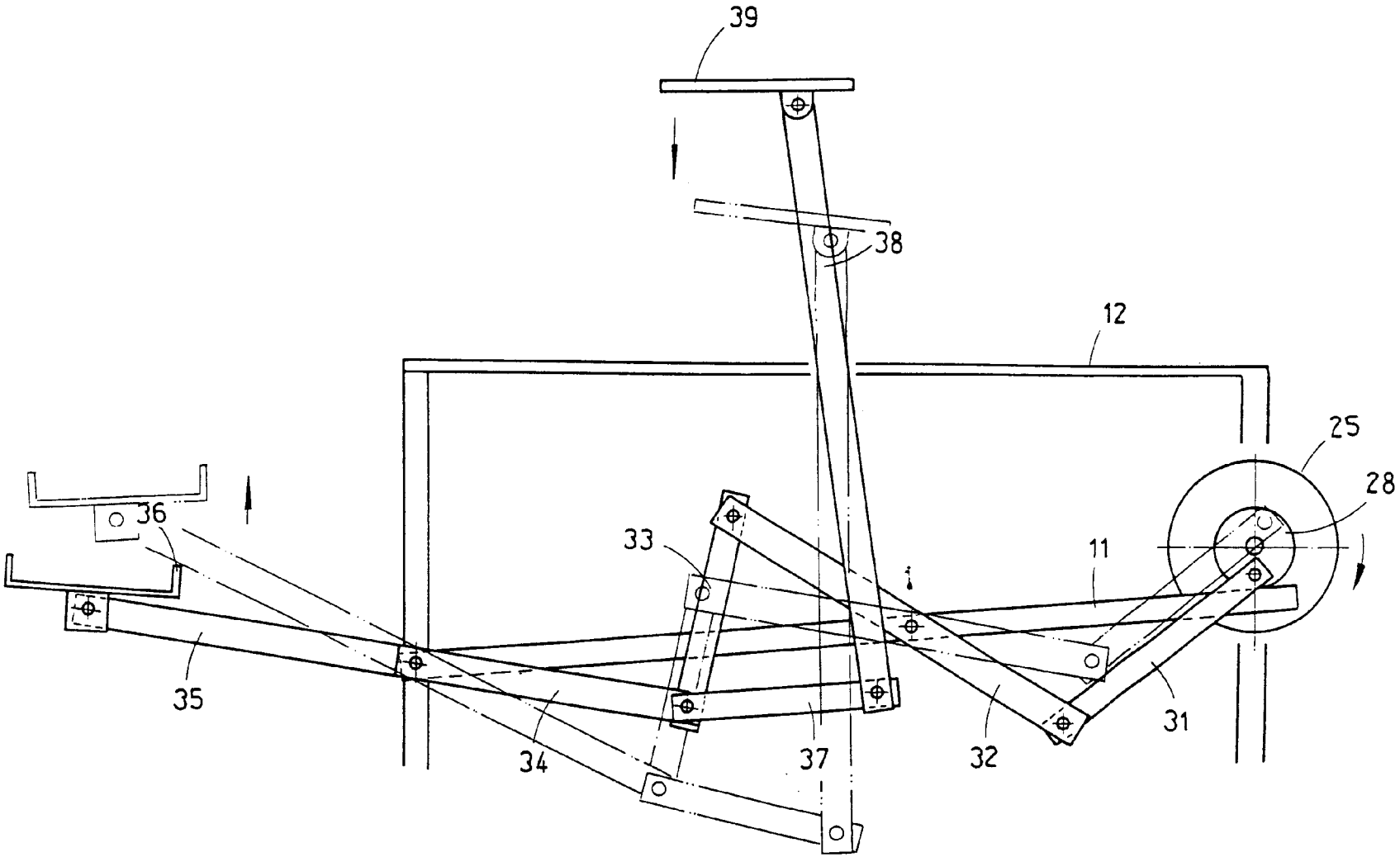
FIG. 6 is an operating procedure illustration of a transmission mechanism of the present invention.

A speed reduction mechanism 2 and a transmission mechanism 3 are installed within a casing 1 which is formed by connecting a middle frame 11, an upper frame 12 and a lower frame 13, a shaft seat 14 is installed at central and end sections of the middle frame 11 to provide for setting up and fixing such reduction mechanism 2, as shown in FIGS. 4–6.

In the reduction mechanism 2, a motor 21 extends to connect with a pinion 22 which is engaged with a first gear

Figure 2:
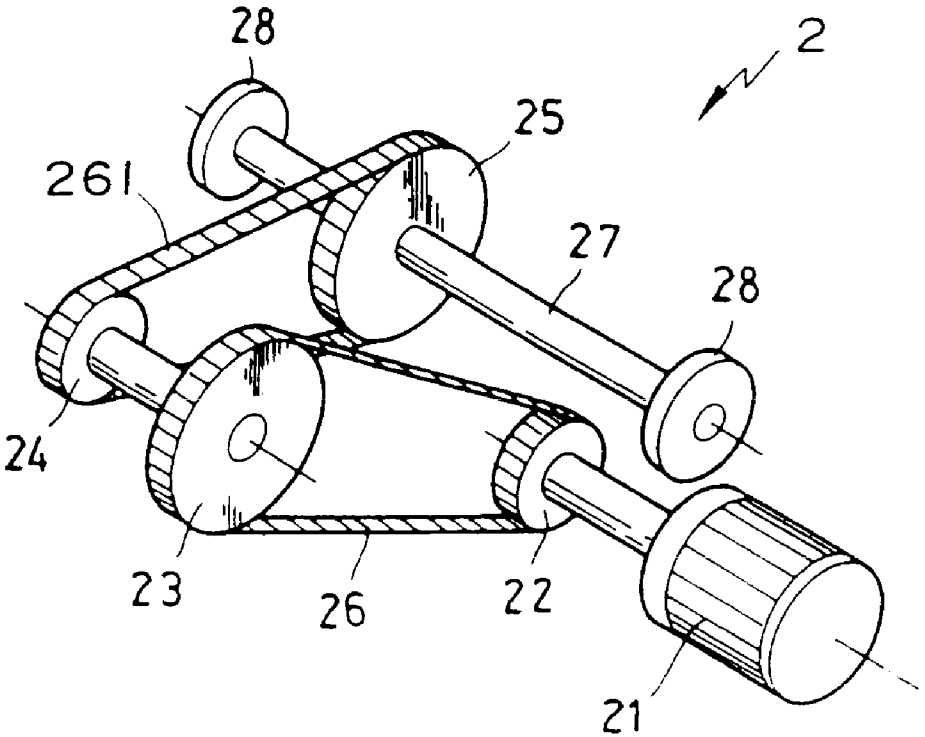
FIG. 2 is a perspective view of a reduction mechanism of the present invention.

23 via a first chain 26. A co-shaft pinion 24 is located at a side of the first gear 23 which engages with a second gear 25 via a second chain 261. The second gear 25 is supported by a shaft seat 14 with a turning shaft 27, and turning discs 28 are mounted at both ends of the turning shaft 27, as shown in FIGS. 2 and 4.

Figure 1:
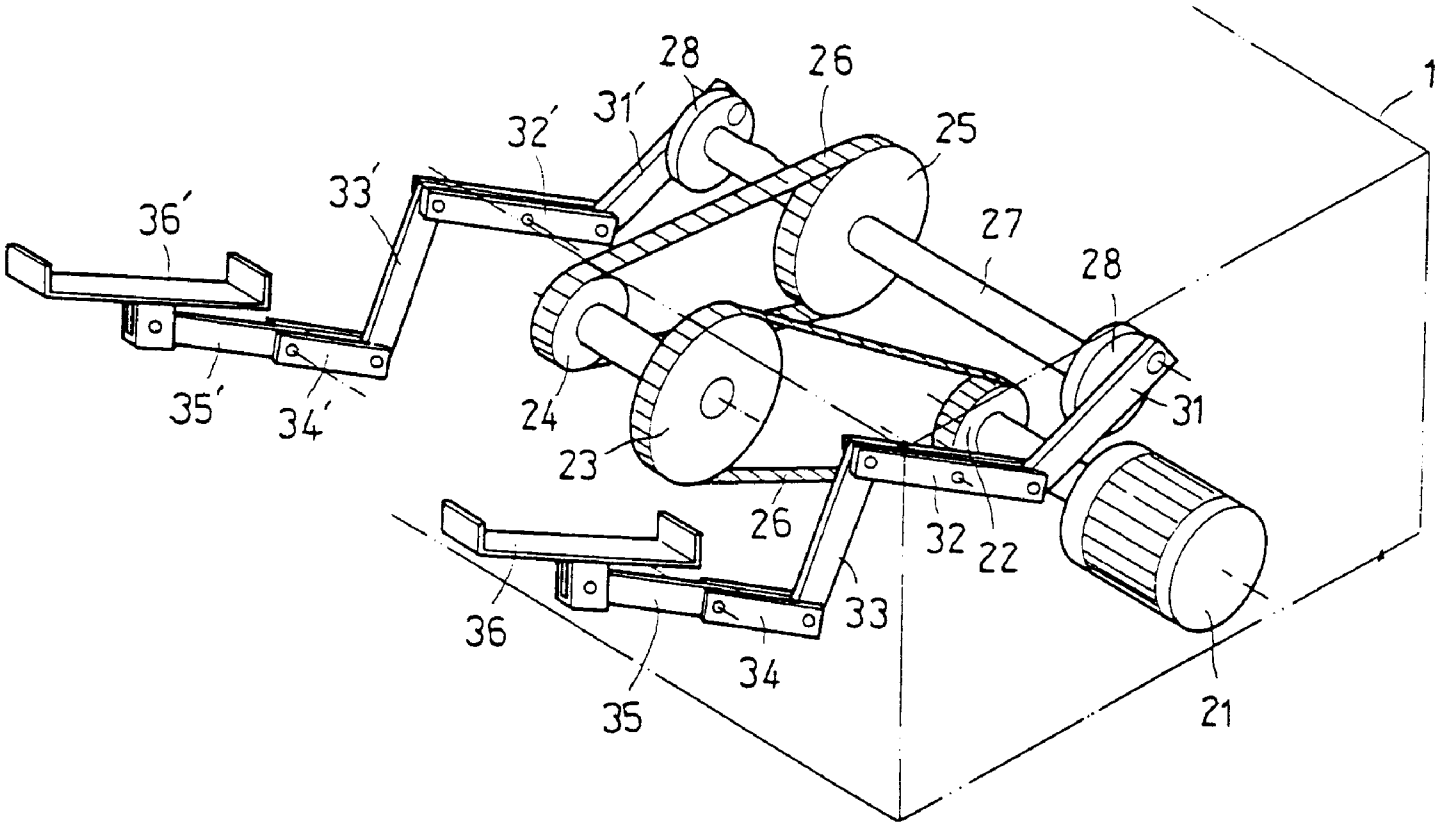
FIG. 1 is a perspective view of the present invention.
Figure 3:
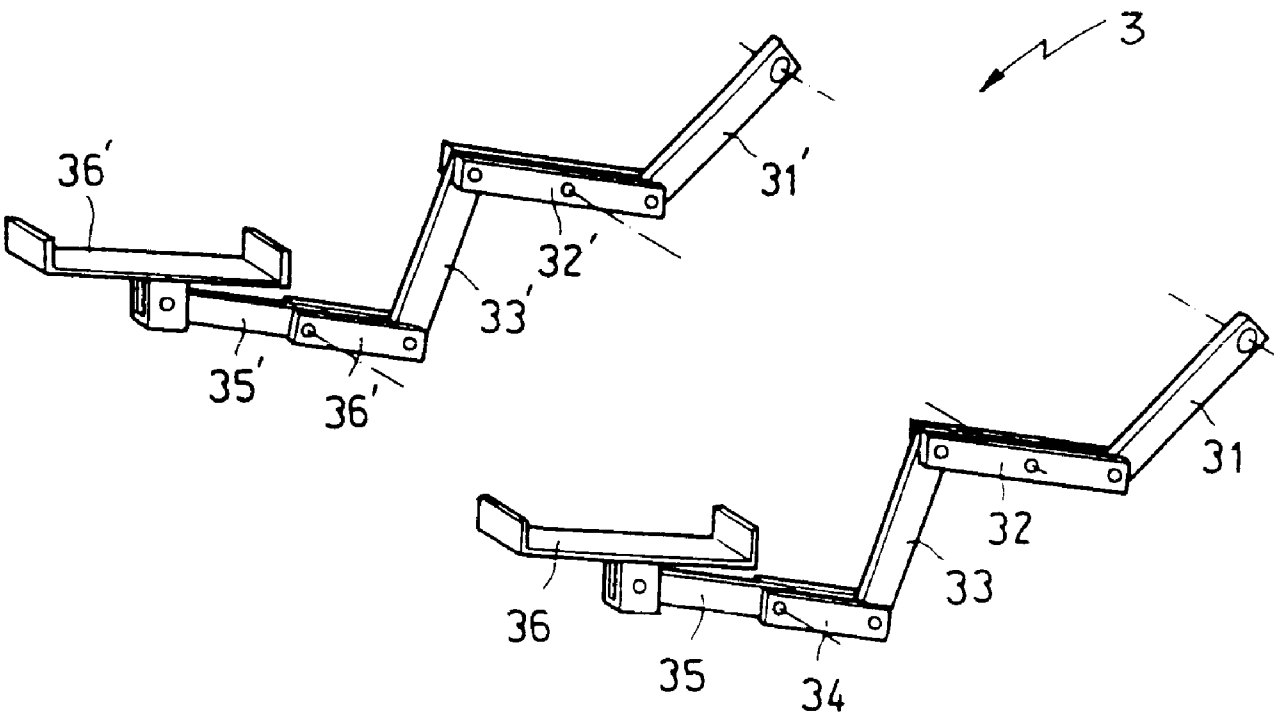
FIG. 3 is a perspective view of a transmission mechanism of the present invention.

Two identical transmission mechanisms 3 are placed at both sides of the reduction mechanism as shown in FIGS. 1 and 3. As shown in FIGS. 5 and 6, the first connecting rods 31, 31' hingedly connect with the turning discs 28, and are in turn, connected with second to fifth connecting rods 32, 32'; 33, 33'; 34, 34'; 35, 35' consecutively, wherein the middle of the second connecting rods 32, 32' and joints of fourth and fifth connecting rods 34, 34'; 35, 35' have pivots. Foot pedals 36, 36' are mounted at front pivot ends of the fifth connecting rods 35, 35'. Sixth and seventh connecting rods 37, 37'; 38, 38' are extended backward from joints of the third and fourth connecting rods 33, 33'; 34, 34', wherein the seventh connecting rods 38, 38'extend upward, such that motion is constrained by the upper frame 12, and hand-plates 39, 39' are pivotally installed on top ends thereof, as shown in FIGS. 5 and 6. Hence, by means of the combination of foregoing elements, during the operation of the machine, the running motor 21 causes the reduction mechanism 2 to turn, from the pinion 22 via a first gear 23, another pinion 24, a second gear 25 to the co-shaft discs 28. The first rods 31, 31' connected to the discs 28 start operating at different setting-levels, one at the top and the other at the lowest position. Using linking operation of first through fifth rods 31, 31'; 32, 32'; 33, 33'; 34, 34'; 35, 35', two pedals 36, 36' on front ends will come to different levels, one at a higher position and the other at a lower position, i.e. such foot-pedals 36, 36' are located at higher and lower positions respectively. Similarly, hand-plates 39, 39' are connected to the top of sixth and seventh rods 37, 37'; 38, 38' extending upward. When the pedal 36 comes to a high point, the plate 39 comes to lower point as shown in FIG. 6. The whole mechanism permits an interlaced motion with higher and lower positions between foot-pedals 36, 36' and hand-plates 39, 39" to enable the rehabilitant's feet and hands to perform a continuous motion.

It should be understood that foregoing figures disclose mechanisms of the present invention. Some type of a sitting chair may be installed on the upper frame 12 of the casing 1 to enable the rehabilitant to perform movement for his feet and hands at a sitting posture. A control switch may be used for adjusting the motor speed of the motor 21.

What is claimed is:

1. An electrically powered rehabilitation treatment machine comprising:

a casing;

a speed reduction mechanism secured to the casing;

a transmission mechanism linked to the speed reduction mechanism and pivotally connected to the casing;

the casing comprising an upper frame, a middle frame and a lower frame, the middle frame comprises a pair of shaft seats;

the speed reduction mechanism comprises an electric motor, the motor comprises a first pinion, the first pinion is engaged with the first gear via a first chain, the first gear comprises a second pinion on a side thereof, the second pinion is engaged to a second gear via a second chain, the second gear is supported on one of the shaft seats of the middle frame, the second gear comprises a turning shaft extended therethrough and a pair of turning discs are secured on respective ends of the turning shaft;

the transmission mechanism comprises two series of connecting rods, each series of connecting rods comprising first, second, third, fourth and fifth connecting rods pivotally and sequentially connected to one another and the first connecting rods are each pivotally connected to respective ones of the turning discs, the second and the fourth connecting rods are hingedly connected to the middle frame of the casing; and a pair of foot pedals are each pivotally and respectively connected at open ends of the fifth connecting rods, a pair of sixth connecting rods are respectively and hingedly connected at connection points between the respective third and fourth connecting rods, open ends of the sixth connecting rods are respectively and hingedly connected to a pair of seventh connecting rods, and a pair of hand plates are hingedly and respectively connected to open ends of the seventh connecting rods.

2. The electrically powered rehabilitation treatment machine as claimed in claim 1, wherein motion of the seventh connecting rods is constrained by the upper frame of the casing.

3. The electrically powered rehabilitation treatment machine as claimed in claim 1, wherein when one of the foot pedals moves in an upward direction, the respectively linked one of the hand plates moves in a downward direction.

* * * * *